US006997678B2

(12) United States Patent
Sun

(10) Patent No.: US 6,997,678 B2
(45) Date of Patent: Feb. 14, 2006

(54) HEAT DISSIPATION FAN WITH FLOW GUIDE DEVICE

(75) Inventor: Sung-Wei Sun, Kaohsiung (TW)

(73) Assignee: Asia Vital Component Co., Ltd., Kaohsiung (TW)

( * ) Notice: Subject to any disclaimer, the term of this patent is extended or adjusted under 35 U.S.C. 154(b) by 54 days.

(21) Appl. No.: 10/792,702

(22) Filed: Mar. 5, 2004

(65) Prior Publication Data

US 2005/0196276 A1 Sep. 8, 2005

(51) Int. Cl.
*F04D 29/54* (2006.01)

(52) U.S. Cl. ..... 415/211.2; 415/220

(58) Field of Classification Search ..... 415/211.2, 415/176, 175, 220, 194, 196 A
See application file for complete search history.

(56) References Cited

U.S. PATENT DOCUMENTS 6,722,418 B1 * 4/2004 Zhang ..... 415/211.2
6,910,862 B1 * 6/2005 Horng et al. ..... 415/211.2
2005/0186070 A1 * 8/2005 Zeng et al. ..... 415/211.2

* cited by examiner

*Primary Examiner*—Edward K. Look
*Assistant Examiner*—Richard A. Edgar

(57) ABSTRACT

A heat dissipation fan includes a fan module and a flow guide device. The fan module further includes a motor stator set and a fan rotor. The motor stator set provides an axial core and an annular join part. The fan rotor is rotationally joined to the axial core. The flow guide device provides a plurality of flow guide blades. An annular section is provided on the flow guide blades and the flow guide blades is integrally made with the annular join part or the flow guide blades is integrally made with a frame and the frame being attached to the motor stator set. The annular section can reduce an eddy flow area, which is formed due to an electronic component impeding the air flow and creating counter air flow under the flow guide blades, so as to increase flow speed and flow rate of the air flow blown by the fan rotor and approaching an electronic component.

4 Claims, 8 Drawing Sheets

212
221
212b
222
212a
22
21
211

21
212
211

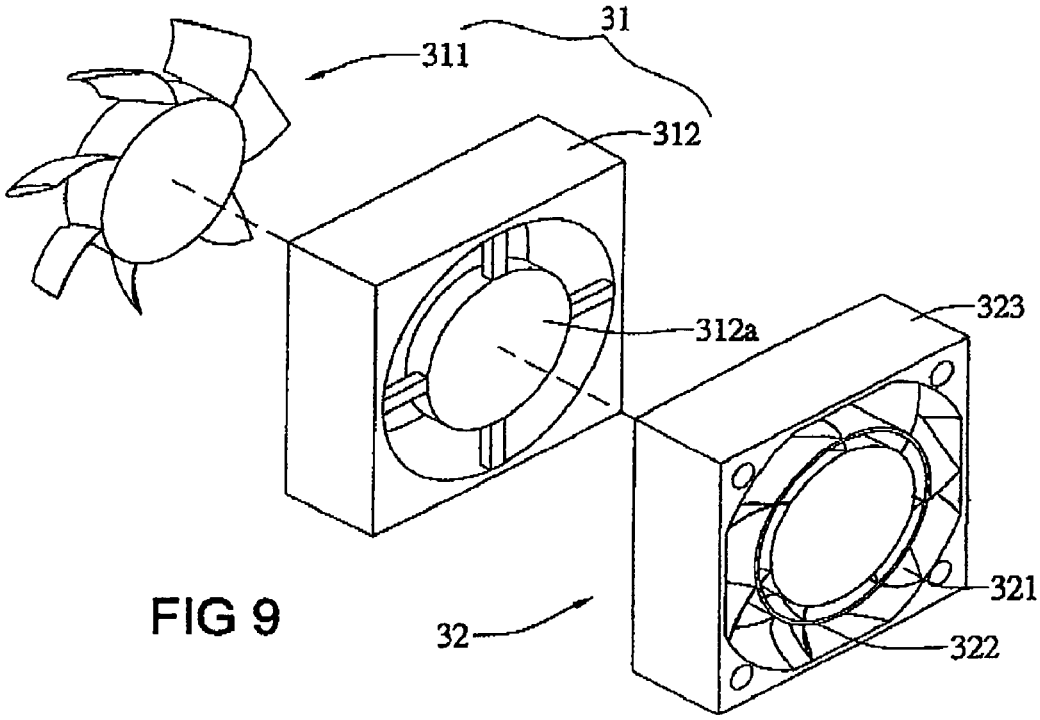
FIG 9
FIG 10
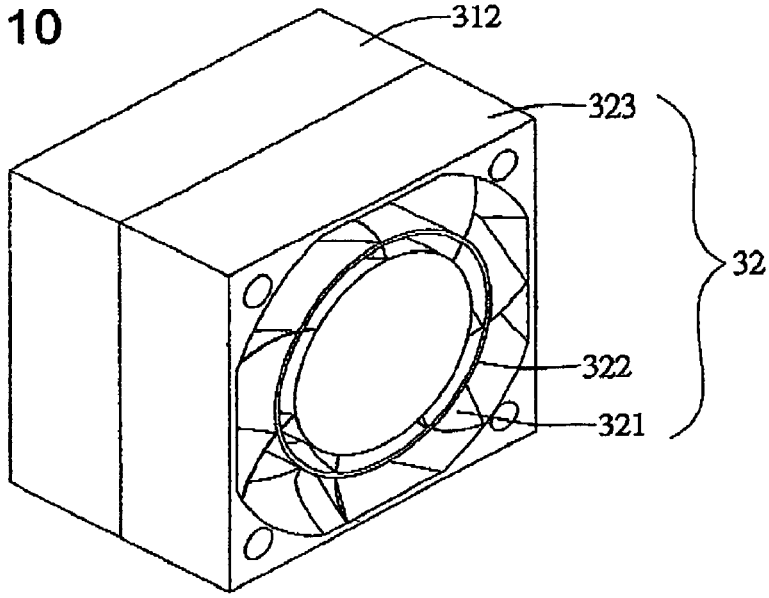

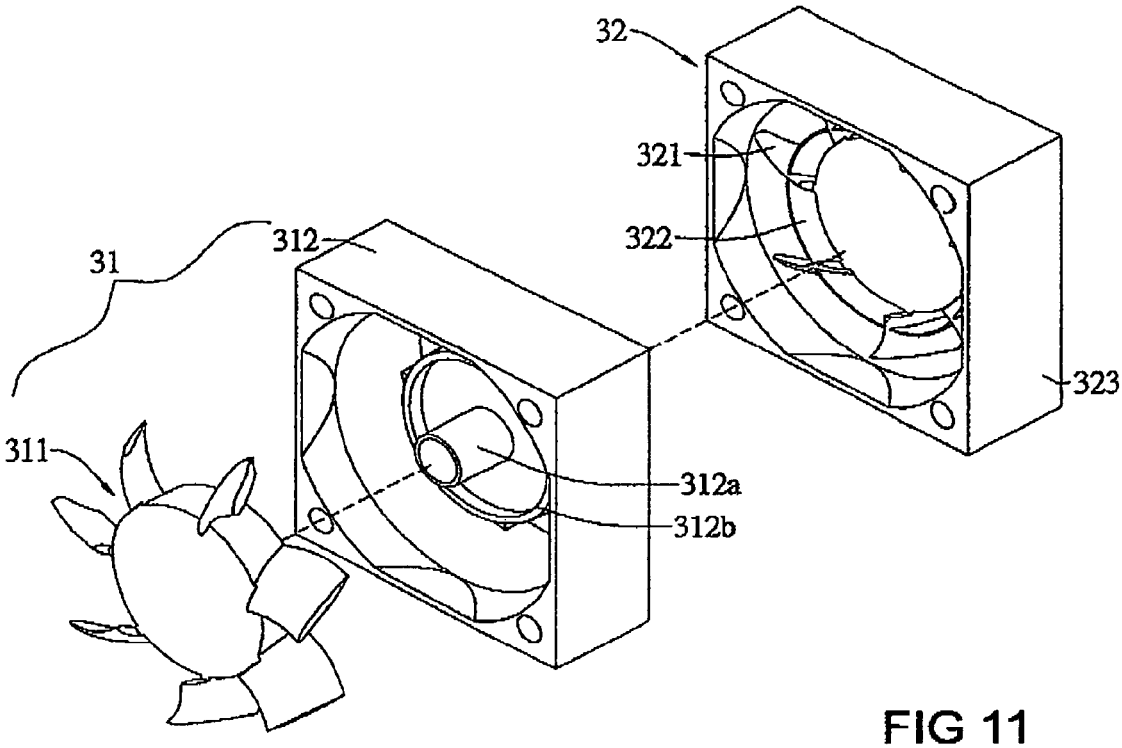
FIG 11
FIG 12
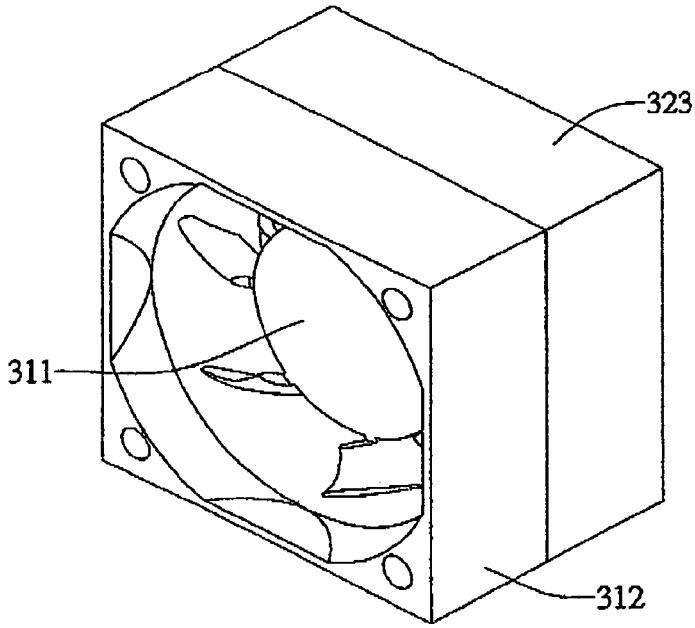

HEAT DISSIPATION FAN WITH FLOW GUIDE DEVICE

BACKGROUND OF THE INVENTION

1. Field of the Invention

The present invention relates to a heat dissipation fan with flow guide device and particularly to a heat dissipation fan, which is provided with an annular part to reduce the eddy flow under the flow guide blades.

2. Brief Description of Related Art

When the electronic component is under operation, a large quantity of heat may generate to affect the smooth operation of the electronic component if the heat is not removed in time effectively. As a result, integral effect of the computer or the information product becomes degraded. In order to remove the heat effectively, usually a metal radiator and a cooling fan are added to the electronic component to speed up removal of the heat. Taiwanese Patent Publication No. 523652, entitled "COMPOSITE TYPE FAN WITH HEAT DISSIPATION FRAME", provides a first frame and a first flow guide part. The first flow guide part is attached to the first frame and composed of a plurality of static blades, which is radially disposed to increase the flow rate and air pressure of the air flow created by a radiation device. However, the counter air flow blown back from the electronic component offsets the downward blown air flow from the cooling fan so as to affect the efficiency of the cooling fan.

SUMMARY OF THE INVENTION

The crux of the present invention is to add an annular section to the flow guide device of a fan module so as to disperse the reversed pressure air flow and to decrease offset effect resulting from both the eddy flow and the reversed pressure air flow such that speed and flow rate of the air flow blown from the fan rotor can be increased for removing the heat of the electronic component speedily and maintaining the electronic component in a normal running state.

Accordingly, an object of the present invention is to provide a heat dissipation heat fan with flow guide device to decrease eddy flow under the flow guide device and increase flow rate and flow speed of downward air flow blown by the fan rotor.

BRIEF DESCRIPTION OF THE DRAWINGS

The detail structure, the applied principle, the function and the effectiveness of the present invention can be more fully understood with reference to the following description and accompanying drawings, in which:

FIG. 9 is an exploded perspective view of a second embodiment of the present invention;

FIG. 10 is an assembled perspective view of the second embodiment;

FIG. 11 is an exploded perspective view of the second embodiment from another projecting angle;

FIG. 12 is an assembled perspective view of the second embodiment from another projecting angle;

DETAILED DESCRIPTION OF THE PREFERRED EMBODIMENTS

Figure 1:
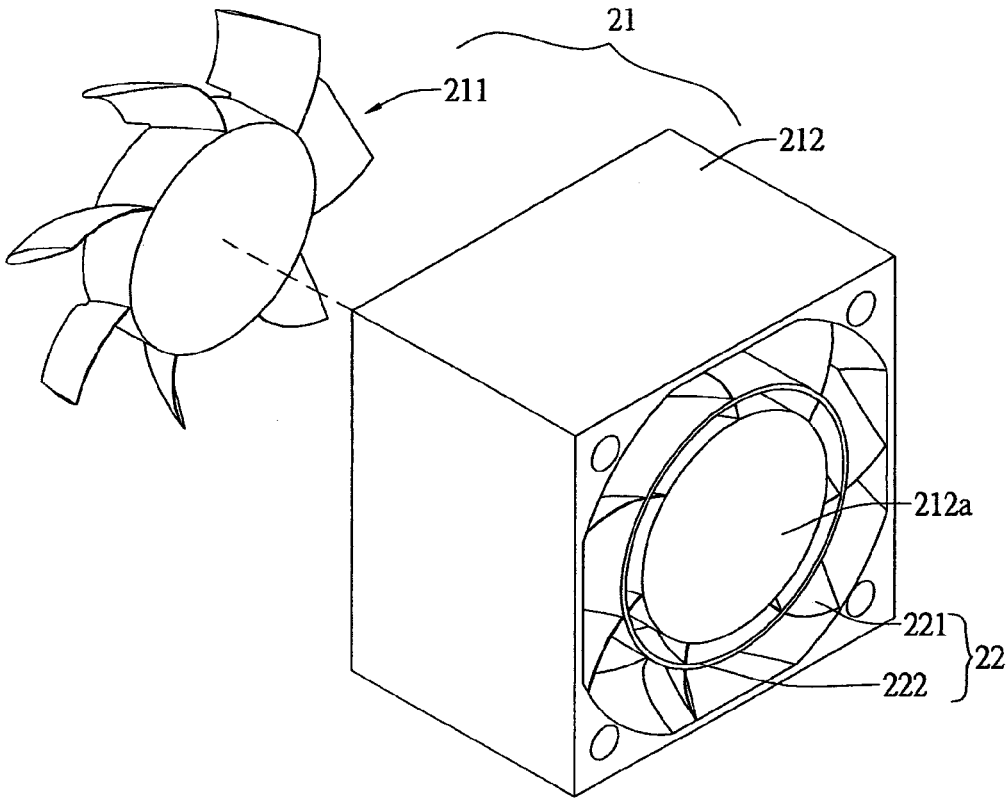
FIG. 1 is an exploded perspective view of a first embodiment of the present invention.
Figure 2:
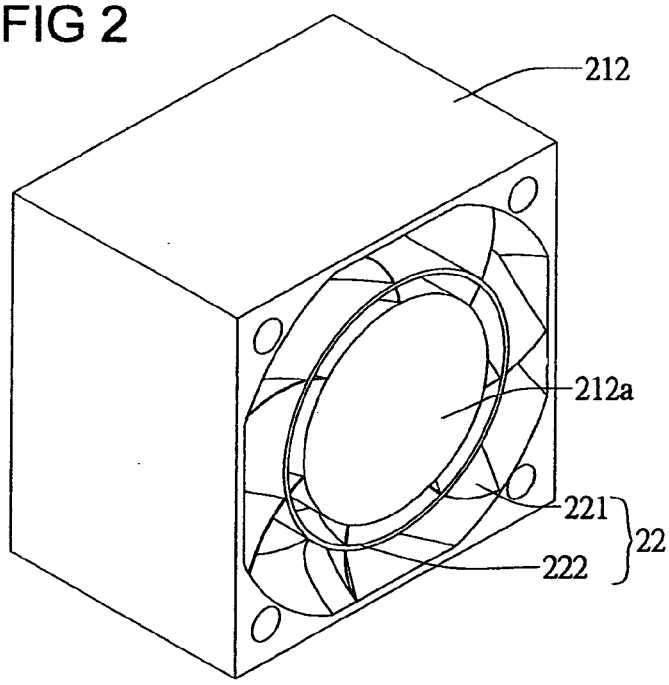
FIG. 2 is an assembled perspective view of the heat dissipation fan shown in FIG. 1.
Figure 3:
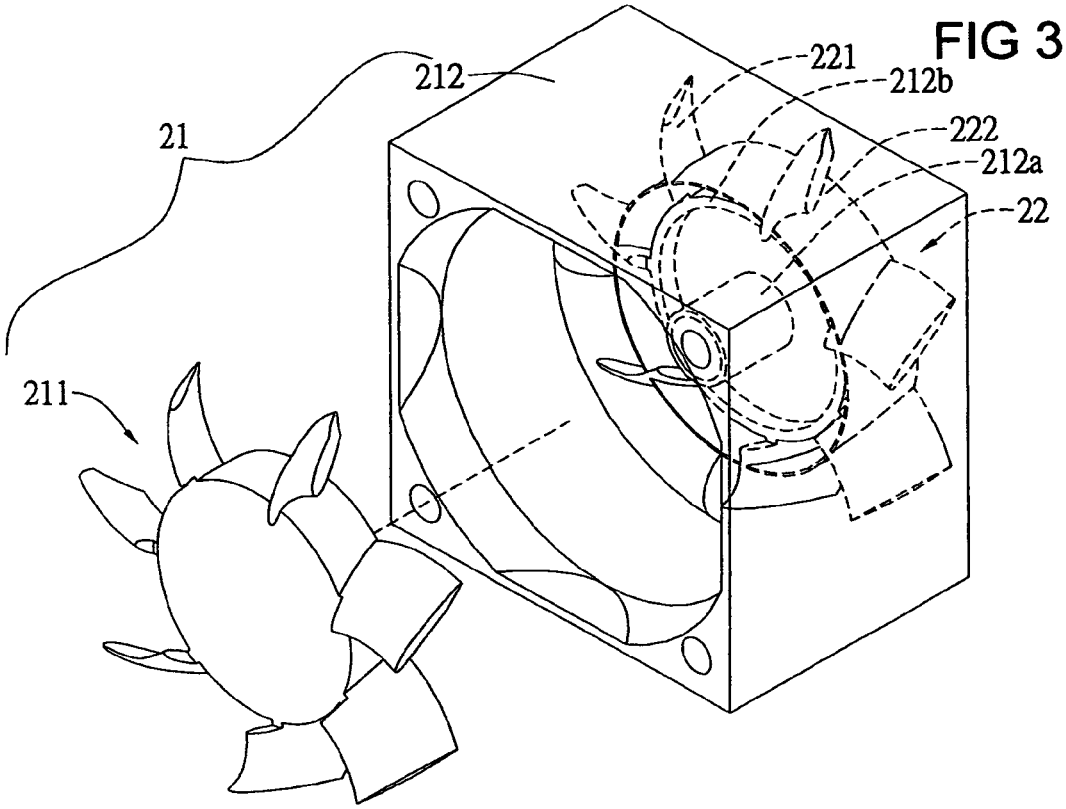
FIG. 3 is an exploded perspective view of the first embodiment from another projecting angle.
Figure 4:
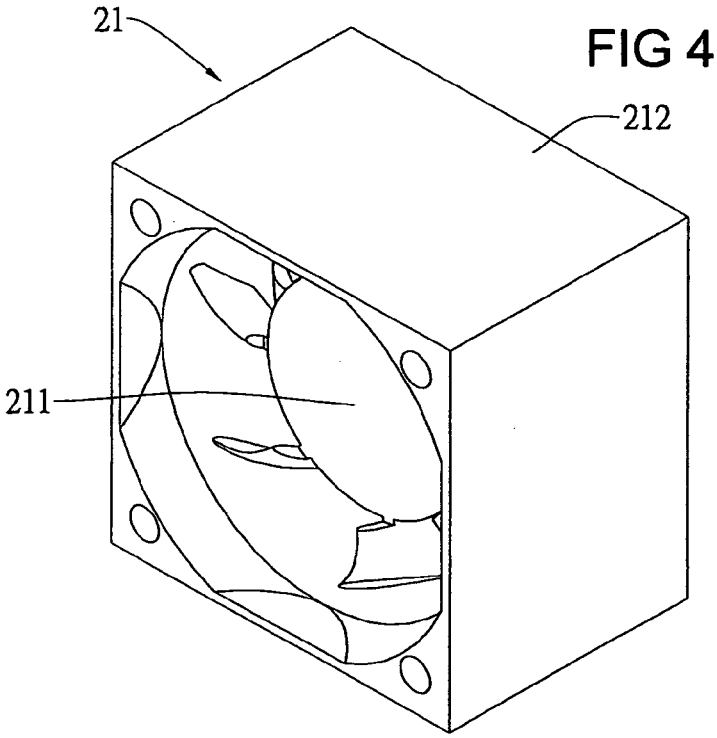
FIG. 4 is an assembled perspective view of the first embodiment from another projecting angle.
Figure 5:
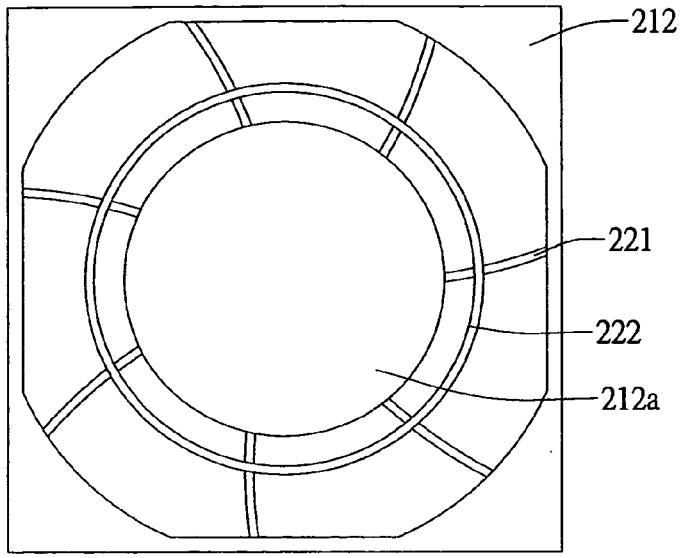
FIG. 5 is a top view of the first embodiment.
Figure 6:
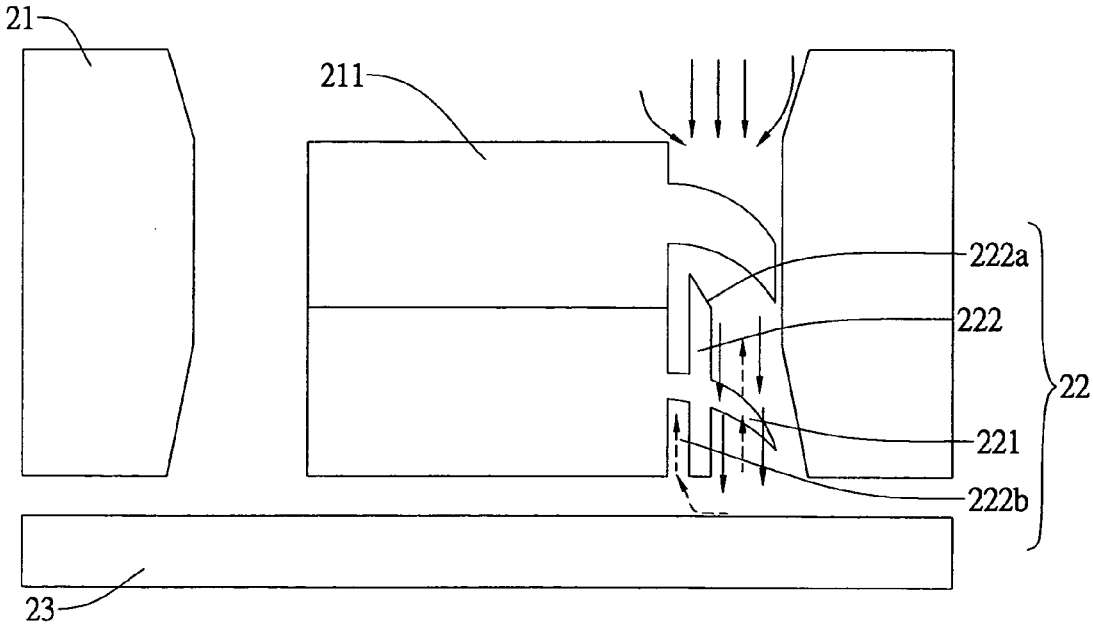
FIG. 6 is a plan view illustrating air flow in the first embodiment.

Referring to FIGS. 1 to 6, a heat dissipation fan with flow guide device according to the present invention in the first embodiment thereof includes a fan module 21 and a flow guide device 22. The fan module 21 further includes a fan rotor 211 and a motor stator set 212. The motor stator set 212 provides an axial core 212*a* and an annular join part 212*b*. The flow guide device 22 is composed of a plurality of flow guide blades 221 and the flow guide blades 221 is integrally made as a piece. The flow guide blades 221 are provided with an annular section 222 with a slant 222*a* and the annular section 222 forms at the inner side thereof a annular space 222*b*.

The fan rotor 211 is rotationally joined to the axial core 212*a* of the motor stator set 212 and the annular section 222 is disposed to surround the flow guide blades 221. The slant 222*a* is capable of increasing the speed of the air flow and guide air direction.

Once the fan module 21 is powered on, the air flow generated from rotation of the fan rotor 211 can flow to an electronic component 23 via the air guide device 22. The air flow is impeded by the electronic component and moves upward and then occurs counter air flow under the air guide blades 221. The annular section 222 disperses the counter air flow and reduces the complete counter flow area. Further, the annular section 222 can avoid occurring the eddy flow so that flow rate of the eddy flow is decreased effectively. The slant 222*a* at the upper edge of the annular section 222 can accelerate the flow speed of downward air flow blown by the fan rotor and increase the flow rate of the air flow approaching the electronic component 23 effectively. Hence, an enhanced heat dissipation of the fan module 21 can be obtained effectively.

Figure 7:
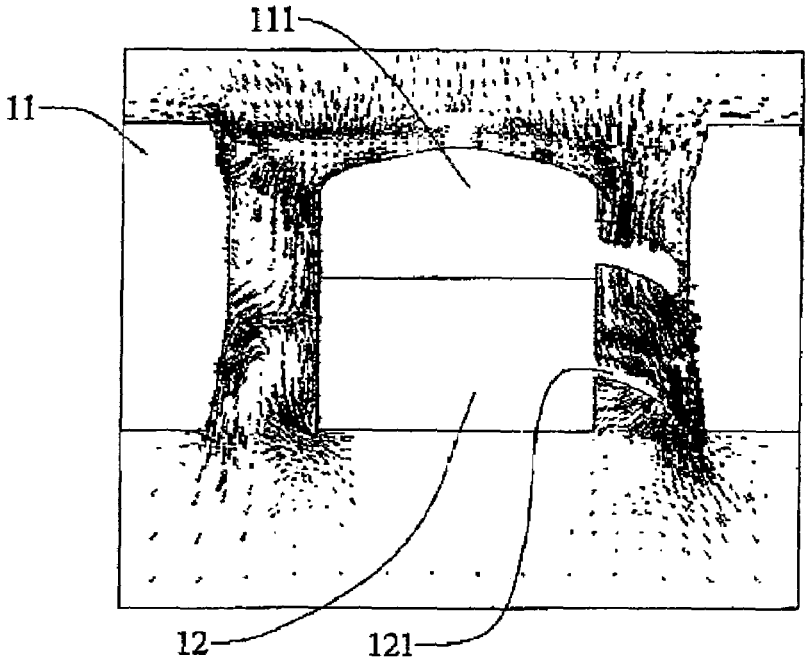
FIG 7 (Prior Art)
FIG. 7 is a graph illustrating experimental air flow of the prior art.
Figure 8:
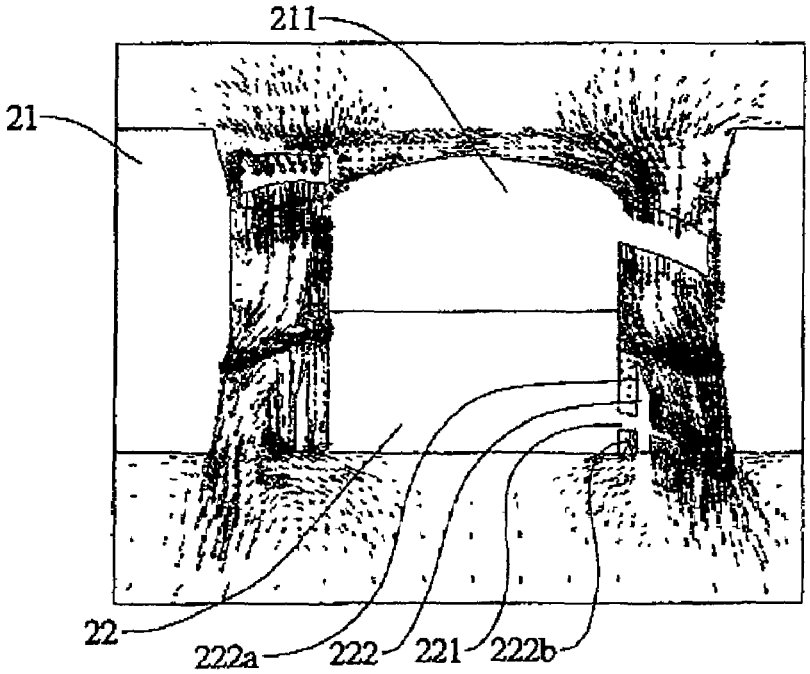
FIG. 8 is a graph illustrating experimental air flow of the first embodiment of the present invention.
Figure 13:
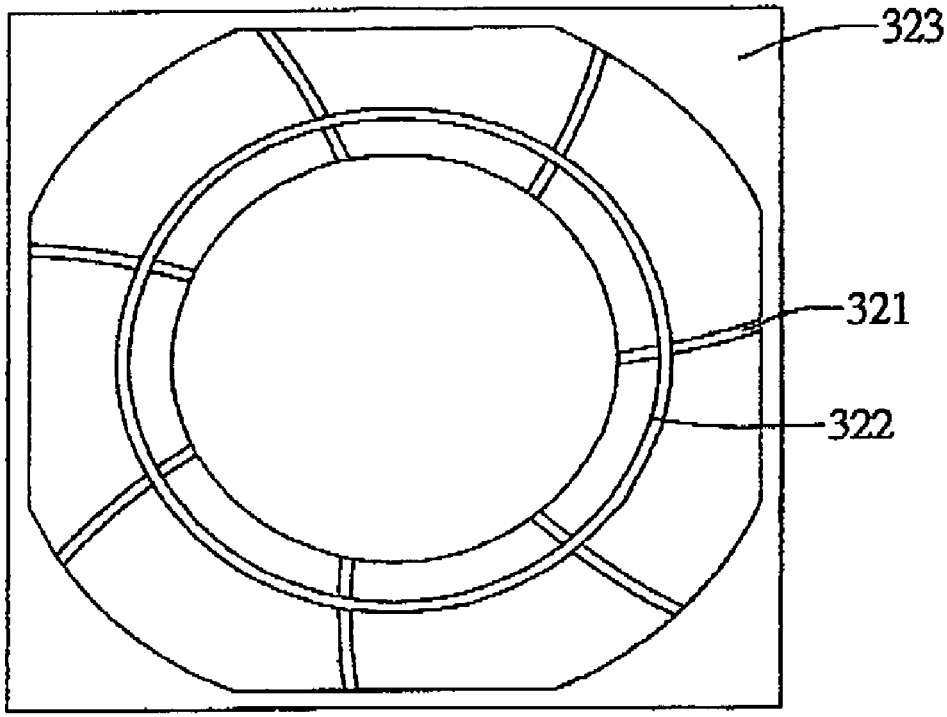
FIG. 13 is a top view of the second embodiment.
Figure 14:
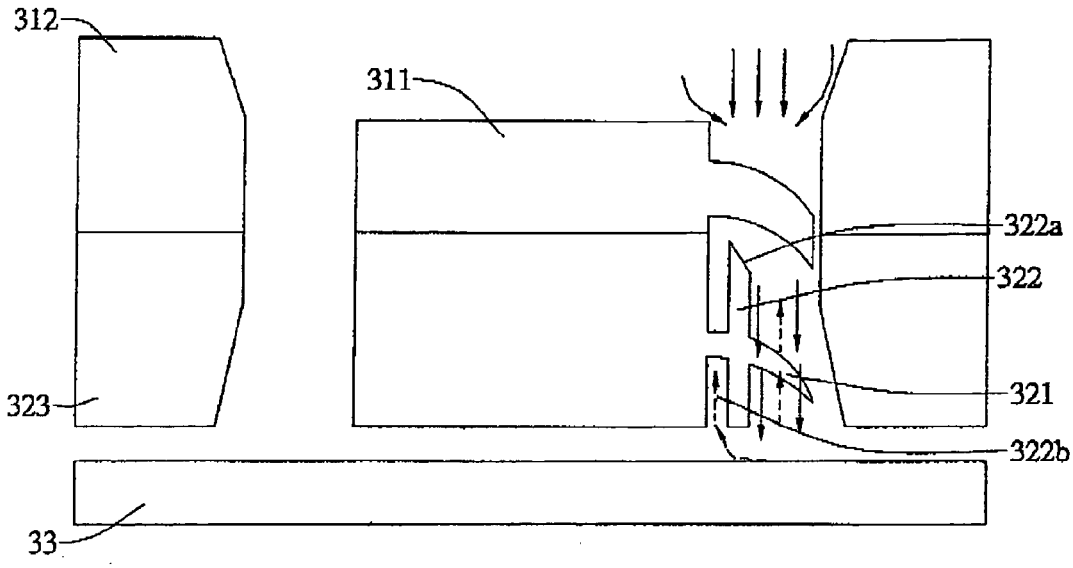
FIG. 14 is a plan view illustrating air flow in the second embodiment of the present invention.

Referring to FIGS. 7 and 8, graphs shown illustrate experimental results of air flows done by a fan with conventional flow guide device and a fan of the present invention respectively. The air flow of with conventional flow guide device shown in FIG. 7 provides the heat dissipation module 11 thereof with the fan rotor 111 rotationally joined to the flow guide device 12 of the radiation blades 121. Comparing FIG. 8 to FIG. 7, it can be understood that the counter air flow under the air guide device 22 in FIG. 8 can be dispersed due to the annular section 222 being added to the guide air device 22 in the present invention such that the eddy flow in the annular space 222*b* is reduced effectively and the area of the eddy flow below the guide air device 22 is decreased substantially. Further, the annular section 222 provides at the upper edge thereof with the slant 222*a* to accelerate the speed of downward air flow blown by the fan rotor 211. In this way, the annular section 222 is capable of decreasing the downward air flow conflicting to the counter air flow so as to increase the flow rate and the flow speed of the air flow approaching the electronic component 23 during the fan rotor 211 running. Therefore, heat generated by the electronic component 23 can be removed and the electronic component 23 can be maintained in a state of normal operation.

Referring to FIGS. 9 to 14, a heat dissipation fan with flow guide device according to the present invention in the second embodiment thereof includes a fan module 31 and a flow guide device 32. The fan module 31 further includes a fan rotor 311 and a motor stator set 312. The motor stator set 312 is provided with an axial core 312*a* and an annular join part 312*b*. The flow guide device 32 is composed of a plurality of guide air blades 321, which are integrally made with a frame 323 and disposed to surround the frame 323. An annular section 322 is disposed on the flow guide blades 321 and a slant 322*a* is at the upper edge of the annular section 322 and an annular space 322*b* is formed at the inner side of the annular section 322.

The fan rotor 311 is rotationally joined to axial core 312*a* of the motor stator set 312 and the annular section 322 is disposed to surround the flow guide blades 321*a* of the guide air device 32. The slant 322*a* at the upper edge of the annular part 322 to increase the air flow speed and to guide the air flow direction. The frame 323 is mounted to the motor stator set 312.

When the fan module 31 is powered on, the air flow is formed to approach the electronic component 33 via the flow guide device 32 while the fan rotor 311 is in a state of running. The air flow blown from the fan rotor 311 is impeded by the electronic component 33 and moves backward as counter air flow under the flow guide blades 321. Hence, provision of the annular section 322 disperses the counter air flow and decreases the integral area of the counter air flow under the flow guide blades 321. Further, the annular section 322 can avoid the eddy flow being created in the annular space 322*b* so that it is possible to reduce the moving area of the eddy flow for reducing the flow rate of the eddy flow effectively. Further, the slant 322*a* on the annular section 322 can accelerate downward air flow so that the flow rate and speed of the air flow approaching the electronic component 33 can increase effectively to enhance heat dissipation of the fan module 31.

Figure 15:
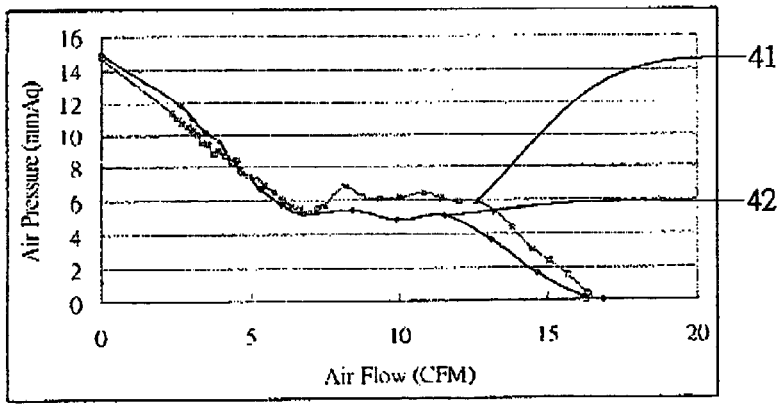
FIG. 15 is a graph illustrating experimental air flow curves of the present invention and the prior art respectively.

Referring to FIG. 15, experimental curves of air pressures with respect to air flows for both the present invention and the prior art are illustrated respectively. The vertical axis represents the air pressure, i.e., air flow pressure resulting from the counter air flow, and the unit thereof is mmAq. The horizontal axis represents the air flow, i.e., the air flow generated from running of the fan rotor 111, 211, 311 and the unit thereof is cubic feet per minute. It is noted that the experimental curve 41 stands for the present invention and the experimental curve 42 stands for the conventional fan. It can be seen that under the same air flow pressure, the air flow generated by the present invention is 14% more than that generated by the conventional fan in the high flow rate zone, in which the flow rate being greater than 12 CPM. The result obtained is that the annular section 222, 322 is capable of reducing the eddy flow area formed by the counter air flow to prevent the flow passage from being blocked by the eddy flow formed by the counter air flow offsetting the downward air flow blown by the fan rotor 211, 311. Hence, the integral quantity of the air flow rate is not possible to be reduced and the deficiency of the prior art can be overcome effectively.

While the invention has been described with referencing to preferred embodiments thereof, it is to be understood that modifications or variations may be easily made without departing from the spirit of this invention, which is defined by the appended claims.

What is claimed is:

1. A heat dissipation fan, comprising a fan module, further comprising a motor stator, which provides an axial core and an annular join part, and a fan rotor, which is rotationally joined to the axial core; and a flow guide device, providing a plurality of guide flow blades;

characterized in that an annular section is provided on the flow guide blades and the flow guide blades are integrally made with the annular join part; whereby, the annular section can reduce an eddy flow area, which is formed due to an electronic component impeding the air flow and creating counter air flow under the guide air blades, so as to increase flow speed and flow rate of the air flow blown by the fan rotor and approaching an electronic component.

2. The heat dissipation fan defined in claim 1, wherein the annular section provides at the upper edge thereof a slant to increase speed and flow guide direction of the air flow.

3. A heat dissipation fan, comprising:

a fan module, further comprising a motor stator, which provides an axial core and an annular join part, and a fan rotor, which is rotationally joined to the axial core; and a flow guide device, providing a plurality of flow guide blades;

characterized in that an annular section is provided on the flow guide blades and the flow guide blades are integrally made with a frame and the frame being attached to the motor stator set;

whereby, the annular section can reduce an eddy flow area, which is formed due to an electronic component impeding the air flow and creating counter air flow under the guide air blades, so as to increase air flow speed and flow rate blown by the fan rotor and approaching an electronic component.

4. The heat dissipation fan as defined in claim 3, wherein the annular section provides at the upper edge thereof a slant to increase speed and the flow guide direction of the air flow.

* * * * *